United States Patent [19]

Adolf et al.

[11] 4,254,615

[45] Mar. 10, 1981

[54] APPARATUS FOR CONTROLLING THE BOBBIN DRIVE OF A FLYER ROVING FRAME

[75] Inventors: Hermann Adolf; Bernhard Grupp, both of Ingolstadt, Fed. Rep. of Germany

[73] Assignee: Schubert & Salzer, Ingolstadt, Fed. Rep. of Germany

[21] Appl. No.: 29,384

[22] Filed: Apr. 12, 1979

[30] Foreign Application Priority Data

Apr. 22, 1978 [DE] Fed. Rep. of Germany ..... 2817711

[51] Int. Cl.[3] ..... D01H 7/50

[52] U.S. Cl. ..... 57/96; 57/93; 57/94

[58] Field of Search ..... 57/67, 68, 70, 71, 94, 57/95, 96, 100

[56] References Cited

U.S. PATENT DOCUMENTS

| | | | |
|---|---|---|---|
| 2,901,882 | 9/1959 | Granberry | 57/71 X |
| 2,901,883 | 9/1959 | Granberry | 57/71 X |
| 3,470,895 | 10/1969 | Joy | 57/95 X |

*Primary Examiner*—Donald Watkins

*Attorney, Agent, or Firm*—Bailey, Dority & Flint

[57] ABSTRACT

A device for controlling the bobbin drive of a flyer roving frame which has a bobbin, a flyer and drive roll thereon that are utilized for building a bobbin with yarn. A drive for the frame incorporating a differential gear and controls are provided for adjusting the driving speed of the flyer and drive roll stepwise to different rotational speed stages during the building of the bobbin. An additional speed adjusting device is provided for automatically varying the driving speed of the bobbin within each rotational speed stage. A switching device is provided for automatically switching the rotational speed stages.

8 Claims, 1 Drawing Figure

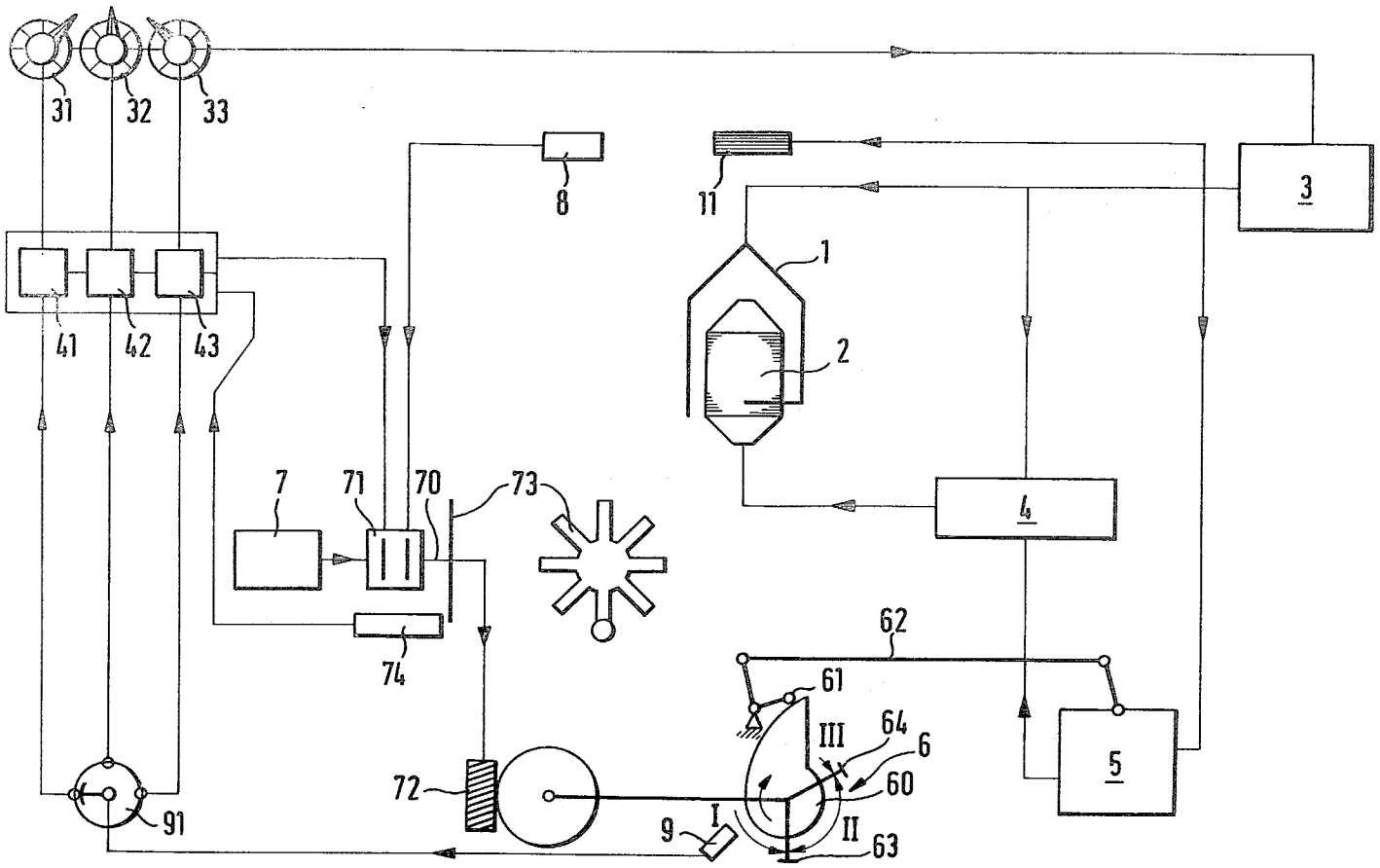
3
5
4
1
2
11
62
6
64
60
63
61
III
II
I
9
8
73
70
71
74
72
7
33
32
31
43
42
41
91

APPARATUS FOR CONTROLLING THE BOBBIN DRIVE OF A FLYER ROVING FRAME

BACKGROUND OF THE INVENTION

The invention relates to an apparatus for controlling the bobbin drive of a flyer roving frame, the drive of which for the supply rolls and the flyers can be stepwise adjusted, during building the bobbin, to different rotational speeds. The drive contains an adjustable transmission system, which is coupled to a differential gear and which can be acted on by an adjusting element.

On flyer roving frames, the roving supplied by the delivery rolls of a drafting system is given a constant twist by means of a flyer, and a bobbin with conical ends is built from the twisted roving. To achieve this, it is usual to drive the supply rolls and flyers at a constant speed and at a fixed ratio to each other, and to drive the bobbins, which can be moved up and down and are mounted, for example, on a bobbin carriage, at a higher speed than the flyers, so that the bobbin leads the flyer. Corresponding to the increasing bobbin diameter, for orderly winding-up of the roving at a constant delivery speed firstly the bobbin lifting speed and secondly the bobbin lead relative to the flyer must decrease. The variable bobbin rotation speed is effected by an adjustable transmission system, for example, a cone gear, which can be acted on by an adjusting element, in connection with a differential gear. The circumstance that the tension of the roving on the bobbin increases with increasing bobbin diameter because of the increasing centrifugal forces is taken into account by having the flyers revolve, not at their highest possible speed, but at a speed of rotation which is from the beginning set lower, which corresponds to the centrifugal force at the full bobbin diameter, and which is constant during the whole building of the bobbin. This does in fact prevent roving breaks and thin places on the bobbin in the end phase of bobbin formation; however, these measures lead to a considerable loss of production.

It has therefore already been proposed to reduce the speed of the flyer and delivery roller during bobbin buildup, while maintaining the required speed ratio between the bobbin and flyer for an orderly windup (British Pat. No. 1,205,555). The proposal envisages starting from the highest possible flyer speed or, as the case may be, adjusting the programmed machine speed such that it begins below that speed which produces the maximum surface speed of the bobbin. This speed is kept constant until the bobbin reaches a diameter which corresponds to that which provides the maximum bobbin surface speed. From there onwards, there comes into action the switch element of a control gear directly following, and driven by, the drive motor, and automatically adjusts the machine speed in order to keep the bobbin surface speed constant at the maximum value. The switch element is actuated by a reciprocable rod which displaces the belt of a hyperbolic-cone cone gear and which itself is moved by a switch apparatus which is not further described since it is conventional. These conventional switch apparatuses or adjusting elements change the belt rod over in constant switching steps during the whole bobbin buildup, with a cone gear with hyperbolic cones.

With the change of the rotational speed of the flyer, however, the pressure of the presser finger and the frictional conditions in the flyer change, with the consequence that the layers of roving wound on the bobbin correspondingly change in thickness. It is thus not possible in practice to use constant switching steps for the adjusting gear or a constant switching angle for the adjusting element influencing the output rotational speed of the adjusting gear, during bobbin buildup, since in this case there arise different tensions of the roving between the supply roller and the bobbin. The operability of the known apparatus is thus not guaranteed.

SUMMARY OF THE INVENTION

The apparatus in accordance with the present invention is provided for controlling the bobbin drive of a flyer roving frame which has a flyer associated with a bobbin upon which yarn is built thereon. A drive roll supplies roving to the flyer and drive means is provided for driving the flyer, supply roll and the bobbin. A differential gear (4) is interposed between the drive means and the bobbin. An adjustment means is connected to the differential gear for varying the speed of rotation of the bobbin. Means (31, 32, 33) is provided for controlling the drive means for adjusting the drive speed of the flyer and drive roll stepwise to different rotational speed stages during building of the bobbin. Within each of these rotational speed stages means is provided for stepwise varying the adjustment means a different degree so as to vary the driving speed of the bobbin to different degrees according to predetermined settings within the varius rotational speed stages.

A bobbin stroke switch (8) generates a stroke signal responsive to a change in stroke of the bobbin and this signal is utilized for triggering an auxiliary drive means (7), (72) for varying the adjustment means (6) responsive to being activated. Pulse counters (41, 42 and 43) are provided for counting pulses that are initiated upon receiving the stroke signal for controlling the drive means that varies the adjusting means (6). Each respective rotational speed stage has a pulse counter associated therewith for controlling the duration that a cam (60) forming part of the adjustment means is driven for stepwise varying the speed of rotation of the bobbin within each stage.

Accordingly, it is an important object of the present invention to provide an apparatus for controlling the bobbin drive of a flyer, and in particular for controlling the driving speed of the flyer and bobbin during different rotational speed stages while building yarn on the bobbin.

Another important object of the invention is to provide an apparatus for controlling the drive of a flyer roving frame, making possible an orderly windup of the roving with a stepwise change of flyer rotational speed to increase production.

These and other objects of the present invention will become apparent upon reference to the following specification, attendant claims and drawing.

BRIEF DESCRIPTION OF THE DRAWING

The FIGURE illustrates a block diagram of an apparatus constructed in accordance with the present invention.

DESCRIPTION OF A PREFERRED EMBODIMENT

An example of an embodiment of the apparatus according to the invention will be described below, with reference to the appended diagrammatic drawing.

The drive of the roving frame, of which only one flyer 1 and a bobbin 2 associated with it are shown, is effected by a drive motor 3, the rotation speed of which can be regulated. This motor conventionally drives a main drive shaft (not shown), with which are drivingly connected the flyer 1 having, for example, a suspension mounting, and the delivery roll 11 of the drafting system. Hence the ratio between the rotational speed of the supply roll 11 and that of the flyer 1 corresponds to the required twist to be applied to the roving.

The bobbins 2 are mounted on a bobbin carriage (not shown) which moves up and down, so that they move vertically relative to the flyers 1 in the required manner for winding the roving. However, the up and down motion of the bobbins can if necessary also be conventionally effected by means of screw spindles. The drive of the bobbins 2 is obtained from a differential gear 4 in which a first drive coming from the main drive shaft and a second drive coming from an adjusting gear 5 are mixed such that the bobbin leads relative to the flyer, The adjusting gear 5, for example a cone year or another steplessly adjustable transmission, is driven from the main drive shaft. Its output rotation speed is acted on by an adjusting element 6, which is an eccentric 60 in the example of an embodiment. Its roller 61 is connected to the adjusting gear 5 by a lever rod 62. A more extensive explanation would be superfluous, since these parts are conventional. Rotation speed selectors are associated with the drive motor 3 and can determine the rotation speed of the drive motor 3 in steps. In the drawing are shown three rotation speed selectors 31, 32 and 33, but if necessary only two, or more than three, rotation speed selectors can also be provided. To each of the rotation speed selectors 31, 32 and 33 there is associated, as the step transducer for the adjusting element 6, an adjustable pulse counter 41, 42 and 43, with which it is electrically connected.

The eccentric 60 serving as adjusting element 6 is driven by an auxiliary motor 7, which always runs at constant speed, via a coupling 71 located on the drive shaft 70 and via a worm wheel gear 72. A braking mechanism is appropriately associated with the coupling 71, which is, for example, an electromagnetic clutch. The coupling 71 with associated brake is electrically connected to the pulse counters 41, 42 and 43 provided as step transducers, and also to a bobbin stroke turn switch 8, which is actuated by the bobbin carriage at the respective end of a stroke. The pulse counters are fed with pulses generated by a pulse transducer. For this purpose, a pulse emitter 73 is attached to the drive shaft 70 carrying the coupling 71, and according to the view shown is star-shaped from the front. This star-shaped pulse emitter 73 cooperates with a pulse transducer 74 which transmits the generated pulses further to a respective one of the pulse counters 41, 42 or 43.

Corresponding to the predetermined number of three rotation speed selectors 31, 32 and 33, the adjustment path of the eccentric 60 which forms the adjusting element 6 is divided into three predetermined stages or sections I, II and III. Thus the adjustment path according to section I is predetermined for that rotational speed stage of the drive motor 3 which is preselectable by the rotation speed selector 31, the adjustment path according to section II for the second rotational speed stage that can be determined by the rotation speed selector 32, and the adjustment path according to section III for the third rotational speed stage selectable by the rotation speed selector 33. The end of section I of the adjustment path is limited by an adjustable switch element 63, and the end of section II by an adjustable switch element 64. A switch 9 is associated with the switch elements 63 and 64, and when actuated by one of the switch elements acts on a selector switch 91 which can select the rotation speed selectors 31, 32 and 33 and the pulse counters 41, 42 and 43 associated with them. The switch elements 63 and 64 can be switch cams or switch vanes, according as switch 9 is constituted as a mechanical or a contactlessly-operating switch.

The mode of operation is as follows: Before the beginning of machine production, the rotation speed selectors 31, 33 and 32 are set to the respective speed of the drive motor 3 desired in the individual stages; in general the first rotation speed selector 31 is set to the highest possible rotation speed, which is then reduced in stages by the following rotation speed selectors. In particular cases, for example, when using the apparatus in combed-yarn flyer frames, it can however also be necessary to begin in the initial phase with a speed below the highest possible one, and to first set the highest speed only at the second rotation speed switch 32. In the further description of operation, it will be assumed that the highest possible rotation speed is selected with the first rotation speed selector 31.

Further, for each of the pulse counters 41, 42 and 43, the pulses to be counted are to be set as step magnitudes, which are a measure for the displacement path of the adjusting element 6. The pulse number to be set at any given time is ascertained in dependence on the characteristics of the roving to be produced, and is reproducable each time. It will be assumed that the pulse number 123 will be set at the pulse counter 41, the pulse number 133 at the pulse counter 42, and the pulse number 143 at the pulse counter 43. With the stepwise decreasing rotation speed of the drive motor 3, and hence of the flyer 1 and supply roll 11, the pulse number is thus simultaneously and automatically altered. In the present case, in which the rotation speed of the drive motor 3 falls stepwise from a highest value, the pulse number increases.

Corresponding to the above explanations, on setting the flyer frame in operation the flyer 1 and the supply roll 11 are driven at the highest possible speed; hence, the bobbins revolve at the speed corresponding to the delivery speed of the roving, and the stroke of the bobbin carriage is effected at a speed such that the individual turns of the roving wound on the bobbin 2 come to lie closely adjacent. When the bobbin carriage has completed its first stroke, it actuates the bobbin stroke turning switch 8, which acts on the coupling 71 and brings it into the coupling position. The auxiliary motor 7 then drives the eccentric 60 via the worm wheel gear 72 so that the eccentric revolves in the direction of the arrow and, via the roller 61 and the lever rod 62, acts on the adjusting gear 5 in a sense to reduce its output rotation speed.

Simultaneously, the pulse emitter 73 attached to the drive shaft 70 is driven by the auxiliary motor 7, so that its arms run past the pulse transducer 74. Each of the arms releases a pulse, which is further transmitted from the pulse transducer 74 to the pulse counter 41. When the set number of 123 pulses, and hence the preselected step magnitude, is reached, the pulse counter 41 then acts on the coupling 71 and interrupts the drive connection to the eccentric 60, whereupon the braking device which is appropriately associated with the coupling 71 becomes operative and causes the immediate stopping of the drive. This process incessantly repeats until the eccentric 60 has revolved stepwise so far that the switch element 63, which limits the adjustment path of the eccentric as defined by the section I and predetermined for the first stage of rotation speed, acts on the switch 9. Hence the selector switch 91 is actuated and now selects the second rotation speed selector 32 and the pulse counter 42 associated with it, so that the pulses released by the pulse releaser 73 are now counted by the pulse counter 42.

The process of driving the eccentric 60, serving as the adjusting element 6, and its interruption, as described for the first rotation speed stage, is repeated, but with the difference that the drive connection between the eccentric 60 and the auxiliary motor 7 remains until 133 pulses are reached and hence for a longer time as compared with the conditions in the first rotation speed stage. When the eccentric 60 has traveled over the adjustment path predetermined for the second rotation speed stage according to section II, the switch element 64 acts on the switch 9 and hence causes, via the selector switch 91, the selection of the third rotation speed selector 33 and the associated pulse counter 43. Since the last acts on the coupling 71 only after reaching 143 pulses, and hence interrupts the drive connection between the auxiliary motor 7 and the eccentric 60, the drive connection remains in existence for a still longer time in the preceding rotation speed stage.

It follows from the above explanations that the drive of the eccentric 60 forming the adjusting element 6 is controlled in steps which are changed from one rotation speed stage to another. If the machine is started running at the highest possible rotation speed, according to the described example of an embodiment with three states of rotation speed, and this speed is then reduced stepwise, there are imparted to the eccentric 60, in the first rotation speed change, only small adjustment steps after each stroke of the bobbin carriage; the adjustment steps are then increased by predetermined amounts from one rotation speed stage to another. Correspondingly, the output rotation speed of the adjusting gear 5, and hence also that of the differential gear 4 which drives the bobbins 2, is reduced in the first rotation speed stage by each adjustment step by a relatively small amount which, however, then becomes greater from one rotation speed stage to another.

In contrast to this, if a speed is chosen in the initial phase below the highest possible speed, and this speed is then increased in the second stage, a larger number of pulses is set at the pulse counter 41 belonging to the first rotation speed stage than at the pulse counter 42 belonging to the second rotation speed stage. Accordingly, adjustment steps are imparted, in the first rotation speed stage, to the adjustment element 6 which are greater than those in the second rotation speed stage. The sizes of the individual adjustment steps are thus determined according to the material to be processed and according to the predetermined and preselected rotation speed of the drive motor 3 in the individual stages.

The invention is not limited to the described example of an embodiment. Thus, for example, instead of the star-shaped pulse releaser 73, a slotted disk in connection with a photocell can also be used for releasing the pulses. Likewise, instead of the pulse counters 41, 42 and 43 and pulse releaser 73 as step transducers, time relays or mechanical counters can be provided and can determine the predetermined step magnitudes. The auxiliary motor 7 and the coupling 7 can be substituted by a braking motor or by a synchronous motor, starting of which is effected by the bobbin stroke turn switch 8 connected to it, and the stopping of which is effected by the respective step transducer. Further, it is possible to substitute for the rotation-speed-controlled drive motor 3 a non-regulatable motor and to follow this with a regulating gear to which the rotation speed selectors are electrically connected.

What is claimed is:

1. An apparatus for controlling the bobbin drive of a flyer roving frame, a flyer associated with said bobbin; a drive roll supplying roving to said flyer; drive means for driving said flyer, supply roll and said bobbin; a differential gear interposed between said drive means and said bobbin; adjustment means connected to said differential gear for varying the speed of rotation of said bobbin, and means for controlling said drive means for adjusting the driving speed of said flyer and drive roll stepwise to different rotation speed stages during building of said bobbin, the improvement comprising:

means for stepwise varying said adjustment means a different degree within said respective rotation speed stages so as to vary the driving speed of said bobbin within said rotation speed stages.

2. The apparatus as set forth in claim 1 wherein said means for stepwise varying said adjustment means comprises:

a bobbin stroke change switch (8) generating a stroke signal responsive to a change in stroke of said bobbin;

means (41, 42, 43) for generating timing signals of predetermined duration;

drive means (7, 72) for varying said adjustment means (6) responsive to being activated, and means (71) coupled to said stroke change switch (8) for activating said drive means responsive to a stroke change for a predetermined duration under control of said timing signal for varying said adjustment means.

3. The apparatus as set forth in claim 2 further comprising:

said drive means for varying said adjustment means including a motor, said stroke signal initiating energization of said motor and said timing signal controlling the duration that said motor is energized for varying said adjustment means.

4. The apparatus as set forth in claim 2 further comprising:

said means for controlling said drive means for adjusting the driving speed of said flyer and drive roll stepwise to different rotation speed stages including at least two adjustable rotation speed selectors (31, 32, 33) each provided for setting the speed range within a respective speed stage;

one of said means for generating a timing signal (41, 42, 43) of predetermined duration associated with each of said adjustable rotation speed selector (31, 32, 33), and means for changing from one rotational speed stage to another responsive to said adjustment means being varied a predetermined magnitude.

5. The apparatus as set forth in claim 2 further comprising:

said adjustment means including (i) a rotable cam (60);

(ii) an adjustable gear (5) and (iii) a linkage arm (62) extending between said rotatable cam and adjustable gear for adjusting said adjustable gear responsive to said rotatable cam being rotated by said drive means (7, 72), said adjustable gear being operably connected to said differential gear, and said drive means (7, 72) rotating said cam for varying said adjustable gear and differential gear responsive to being activated for varying the speed of rotation of said bobbin.

6. The apparatus as set forth in claim 5 further comprising:

said means for changing from one rotational speed stage to another including, (i) a switch means carried in the rotational path of said cam for being activated by said rotatable cam rotating a predetermined distance;

(ii) a selector switch means connected between said switch means and said means (31, 32, 33) for controlling said drive means for adjusting the driving speed of said flyer and drive roll stepwise to different rotation speed stages, causing the speed stage to change from one stage to another responsive to being activated by said switch means when said cam rotates said predetermined distance.

7. The apparatus as set forth in claim 2 further comprising:

said means for generating timing signals of a predetermined duration include, (i) a pulse counter set to count a predetermined number of pulses, (ii) means (73, 74) for generating a chain of pulses responsive to a stroke signal, and (iii) means for activating said drive means with said pulses for varying said adjustment means until the pulses produced by said means for generating pulses reaches said predetermind number set in said pulse counter.

8. An apparatus for controlling the bobbin drive of a flyer roving frame, a flyer associated with said bobbin, a drive roll supplying roving to said flyer, and drive means for driving said flyer, supply roll and said bobbin; and means for controlling said drive means for driving said flyer and drive roll stepwise at different rotational speed stages during building of said bobbin, the improvement comprising:

means for varying said driving speed of said bobbin to different degree during the different rotational speed stages while building said bobbin.

* * * * *